US007114992B2

(12) United States Patent
Sagawa et al.

(10) Patent No.: US 7,114,992 B2
(45) Date of Patent: Oct. 3, 2006

(54) ELECTRICAL CONNECTOR

(75) Inventors: Tetsuya Sagawa, Kodaira (JP); Yasumasa Aita, Machida (JP); Tomoaki Kajii, Sagamihara (JP); Ryo Sawada, Isehara (JP)

(73) Assignee: Tyco Electronics AMP K.K., Kanagawa-Ken (JP)

( * ) Notice: Subject to any disclaimer, the term of this patent is extended or adjusted under 35 U.S.C. 154(b) by 0 days.

(21) Appl. No.: 10/964,139

(22) Filed: Oct. 13, 2004

(65) Prior Publication Data

US 2005/0124216 A1 Jun. 9, 2005

(30) Foreign Application Priority Data

Oct. 16, 2003 (JP) ..... 2003-356656

(51) Int. Cl.
*H01R 13/40* (2006.01)

(52) U.S. Cl. ..... 439/595

(58) Field of Classification Search ..... 439/752–753, 439/595

See application file for complete search history.

(56) References Cited

U.S. PATENT DOCUMENTS 4,973,268 A 11/1990 Smith et al.
6,149,462 A * 11/2000 Sugie ..... 439/595
6,817,901 B1 * 11/2004 Nishide ..... 439/595
6,835,097 B1 * 12/2004 Nankou et al. ..... 439/595

FOREIGN PATENT DOCUMENTS

JP 09-283203 10/1997

* cited by examiner

*Primary Examiner*—J. F. Duverne
(74) *Attorney, Agent, or Firm*—Barley Snyder LLC

(57) ABSTRACT

An electrical connector reduces backlash of the retainer in a main locking state and increases the rigidity of the front plate of the retainer, while providing dimensional stability, and preventing warpage of the locking arms. The electrical connector comprises a front insertion retainer that is locked to the housing in a temporary locking position and in a main locking position. The retainer comprises a front plate having contact passage holes, and locking arms extending rearward from the upper and lower ends of the front plate. A strip extends in the direction of length and protrudes rearward from the center on the back surface of the front plate, and a recessed groove extends on the front surface of the front plate in a position corresponding to the strip. The housing has a recessed groove that mates with the strip when the retainer is in the main locking position.

12 Claims, 6 Drawing Sheets

ELECTRICAL CONNECTOR

FIELD OF THE INVENTION

The present invention relates to an electrical connector comprising a front-insertion retainer, which is locked to the housing in a temporary locking position that allows the insertion of contacts into the housing and in a main locking position that ensures that the contacts are prevented from slipping out of the housing.

BACKGROUND

A conventional electrical connector, shown in FIGS. 9 and 10 (see Japanese Patent No. 3101203), comprises a retainer that is inserted from the front surface of the housing, i.e., a so-called front insertion type retainer.

This electrical connector 101 shown in FIGS. 9 and 10 comprises an insulating housing 110, a plurality of contacts 120 that are accommodated in the housing 110, and a retainer 130 that is inserted from the front surface of the housing 110 and that double-locks the contacts 120.

A plurality of contact accommodating cavities 111 for accommodating the contacts 120 are formed inside the housing 110 in two rows (upper and lower rows). A housing lance 112 for locking the corresponding contact 120 is disposed inside each contact accommodating cavity 111. Furthermore, protruding wall parts 113 that respectively protrude upward and downward from the top wall and bottom wall of the housing 110 are present on the left and right side walls of the housing 110, and temporary locking steps 114 are formed substantially in the central part in the forward-rearward direction (i.e., substantially in the central part in the left-right direction in FIG. 10) of the respective protruding wall parts 113. Moreover, main locking holes 115 are respectively formed in the rear portions of the top wall and bottom wall of the housing 110. In addition, a partition wall 116 that divides the contact accommodating cavities 111 of the upper and lower rows is formed between these contact accommodating cavities 111 of the upper and lower rows, and a V groove 117 is formed in the front end of this partition wall 116.

Each contact 120 comprises a substantially box-shaped receptacle part 121 that is secured by the corresponding housing lance 112, and an electrical wire connecting part 122 that extends rearward from the receptacle part 121 and that is connected by crimping to one of the electrical wires W.

The retainer 130 is constructed so that this retainer is inserted into the housing 110 from the front surface of the housing 110, and is locked to the housing 110 in a temporary locking position that allows the insertion of the contacts 120 into the contact accommodating cavities 111 and in a main locking position that double-locks the contacts 120. The retainer 130 comprises a rectangular substantially flat front plate 131 that extends in the direction of length (left-right direction in FIG. 9) so as to cover the front surface of the housing 110, and a plurality of locking arms 133 and 134 that respectively extend rearward from the areas in the vicinity of the upper and lower ends of the front plate 131. The retainer 130 is formed by molding an insulating synthetic resin. A plurality of contact passage holes 132 are formed in the front plate 131 in positions corresponding to the contact accommodating cavities 111. Furthermore, temporary locking projections 133*a* are formed so that these projections 133*a* protrude from the side edges on the outside of the respective upper-side locking arms 133 in positions located slightly toward the rear (in the forward-rearward direction) of the respective locking arms 133, and main locking projections 133*b* are formed so that these projections 133*b* protrude from the top surfaces on the rear ends of the respective locking arms 133. Moreover, temporary locking projections 134*a* are formed so that these projections 134*a* protrude from the side edges on the outside of the lower-side locking arms 134 in positions located slightly toward the rear (in the forward-rearward direction) of the respective locking arms 134, and main locking projections 134*b* are formed so that these projections 134*b* protrude from the bottom surfaces on the rear ends of the respective locking arms 133. A plurality of supporting parts 135 that extend in the direction of length are formed so that these supporting parts 135 protrude rearward from the center on the side of the back surface of the front plate 131. The rear ends of the respective supporting parts 135 are formed in a V shape.

When the retainer 130 is in the temporary locking position, the temporary locking projections 133*a* and 134*a* of the retainer 130 are locked on the rear sides of the temporary locking steps 114 of the housing 110, so that the retainer 130 is prevented from slipping out of the housing 110. Moreover, when the retainer 130 is in the main locking position, as is shown in FIG. 10, the main locking projections 133*b* and 134*b* of the retainer 130 are locked in the main locking holes 115 in the housing 110, so that the retainer 130 is prevented from slipping out of the housing 110. In this main locking position, the upper-side locking arms 133 of the retainer 130 are positioned above the housing lances 112, and restrict the upward movement of the housing lances 112, thus accomplishing the double-locking of the contacts 110 of the upper row. Furthermore, the lower-side locking arms 134 of the retainer 130 are positioned beneath the housing lances 112, and restrict the downward movement of the housing lances 112, thus accomplishing the double-locking of the contacts 110 of the lower row. Moreover, in the main locking position of the retainer 130, as is shown in FIG. 10, portions of the rear ends of the supporting parts 135 enter into the V groove 117 of the housing 110, and thus stop movement of the retainer 130 in the vertical direction caused by looseness; furthermore, these portions of the supporting parts 135 also prevent the second locking arms 118 of the housing 110 that lock the contacts 120 from flexing inward.

However, the following problems have been encountered in this conventional electrical connector 101.

Specifically, by providing the supporting parts 135 that protrude rearward from the back surface of the front plate 131 of the retainer 130, backlash of the retainer 130 at the time of main locking can be stopped, and the rigidity of the front plate 131 of the retainer 130 can be increased. However, these supporting parts 135 protrude to the rear in a relatively thick state. Accordingly, the dimensional stability of the retainer 130 is poor in a state in which the retainer 130 is molded. Moreover, the warpage of the locking arms 133 and 134 that extend from the areas in the vicinity of the upper and lower ends of the front plate 131 of the retainer 130 cannot be avoided.

SUMMARY

According to an exemplary embodiment of the present invention, an electrical connector is provided which can prevent warpage of the locking arms and whose retainer itself has superior dimensional stability while stopping backlash of the retainer at the time of main locking and increasing the rigidity of the front plate of the retainer.

The electrical connector according to an exemplary embodiment of the invention, comprises: an insulating housing; contacts that are accommodated in this housing; and a retainer that is inserted from the front surface of the housing, and that is locked to the housing in a temporary locking position that allows the insertion of the contacts into the housing and in a main locking position that ensures that the contacts are prevented from slipping out of the housing. The retainer has a front plate that has contact passage holes, and locking arms that extend rearward from the upper and lower ends of the front plate, wherein the retainer comprises a strip that extends in the direction of length and that protrudes rearward from the center of the front plate on the surface, and also has a recessed groove that extends in the direction of length in the center of the front plate on the front surface and in a position corresponding to the strip, and the housing has a recessed groove that mates with the strip when the retainer is in the main locking position.

DETAILED DESCRIPTION OF THE EMBODIMENT(S)

Next, an embodiment of the present invention will be described with reference to the figures. In FIGS. 1A to 1C and 2A to 2C, the electrical connector 1 comprises an insulating housing 10, a plurality of contacts 20 that are accommodated in this housing 10 in two rows (upper and lower rows), and a retainer 30 for ensuring that the contacts 20 do not slip out.

Figure 1A:
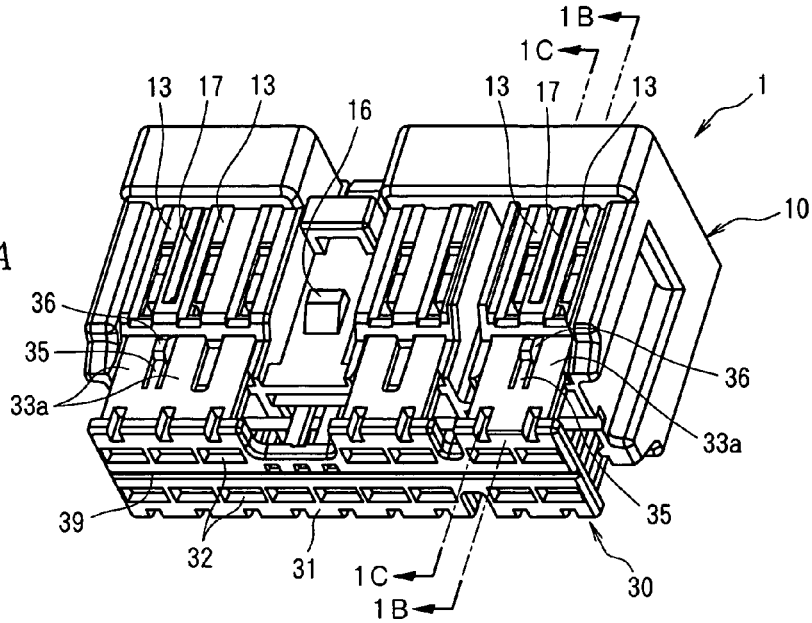
FIGS. 1A to 1C show an electrical connector according to an exemplary embodiment of the invention in a state in which the retainer is in the temporary locking position in the electrical connector of the present invention, with FIG. 1A being a perspective view, FIG. 1B being a sectional view along line 1B—1B in FIG. 1A, and FIG. 1C being a sectional view along line 1C—1C in FIG. 1A (here, the contacts are not shown in FIG. 1B)

The housing 10 is formed with a substantially rectangular shape by molding an insulating synthetic resin, for example, and has a plurality of contact accommodating cavities 11 (that accommodate contacts 20 therein) arranged in two rows (upper and lower rows) in the left-right direction (i.e., the left-right direction in FIG. 1A). As is shown in FIG. 3, each contact accommodating cavity 11 opens on the front side of the housing 10 (left side in FIGS. 1C and 2C, front side in FIG. 3). A housing lance 12 is disposed in each contact accommodating cavity 11, for securing the corresponding contact 20. The housing lances 12 disposed in the contact accommodating cavities 11 of the upper row are formed so that these housing lances extend forward at an inclination from the top wall of the housing 10; on the other hand, the housing lances 12 disposed in the contact accommodating cavities 11 of the lower row are formed so that these housing lances extend forward at an inclination from the bottom wall of the housing 10.

A plurality of first long narrow openings 13 that extend in the forward-rearward direction are respectively formed in the top wall and bottom wall of the housing 10 in positions corresponding to the respective contact accommodating cavities 11 in the left-right direction. The width of the respective first long narrow openings 13 is narrower than the width of the respective contact accommodating cavities 11. Furthermore, spaces 14 that permit flexing of the housing lances 12 and that allow the entry of the upper-side regulating parts 33*a* (described later) of the retainer 30 are formed above the housing lances 12 of the upper row so that these spaces 14 communicate with the first long narrow openings 13. Moreover, spaces 14 that permit flexing of the housing lances 12 and that allow the entry of the lower-side regulating parts 33*b* (described later) of the retainer 30 are also formed beneath the housing lances 12 of the lower row so that these spaces 14 communicate with the first long narrow openings 13. The respective spaces 14 open on the front side of the housing 10. Slits 15 that communicate with the spaces 14 and that open on the front side of the housing 10 are formed on the front side of the housing lances 12 of the respective contact accommodating cavities 11. Moreover, second long narrow openings 17 that extend in the forward-rearward direction are respectively formed in the top wall of the housing 10 between the first long narrow opening 13 at the leftmost end and the adjacent first long narrow opening 13 and between the first long narrow opening 13 at the rightmost end and the adjacent first long narrow opening 13. Furthermore, spaces 18 that allow the entry of the main locking arms 35 (described later) of the retainer 30 are formed beneath the second long narrow openings 17 so that these spaces 18 communicate with the second long narrow openings 17. The spaces 14 described above and these spaces 18 communicate with each other. Furthermore, a locking projection 16 that locks with the mating connector (not shown in the figures) at the time of mating with this mating connector is formed on the top wall of the housing 10.

Figure 1B:
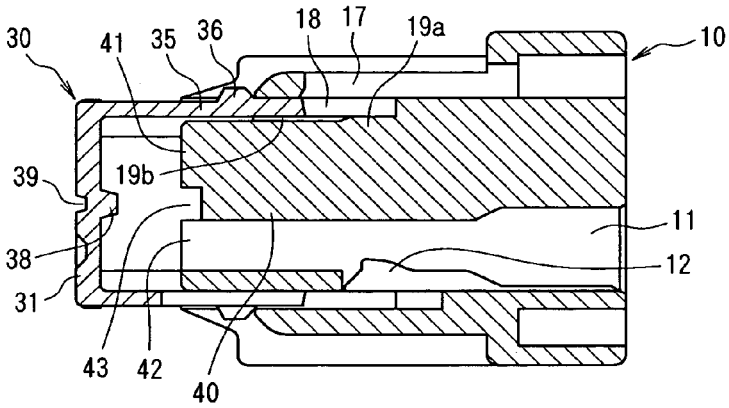

A central partition wall 40 is formed between these contact accommodating cavities 11 of the upper and lower rows, dividing the contact accommodating cavities 11 of the upper and lower rows in the housing 10. Furthermore, as is clearly shown in FIG. 3, cavity partition walls 41 are formed between the adjacent contact accommodating cavities 11 of the upper row, and cavity partition walls 42 are formed between the adjacent contact accommodating cavities 11 of the lower row. As is shown in FIGS. 1B and 3, these cavity partition walls 41 and 42 of the two rows protrude further forward than the central partition wall 40, and this protruding area between the cavity partition walls 41 and 42 of the two rows defines a recessed groove 43.

In an exemplary embodiment, each contact 20 is formed by stamping and forming a metal plate. Each contact 20 comprises a substantially box-shaped receptacle part 21 that is secured by the corresponding housing lance 12, and an electrical wire connecting part 22 that extends rearward from the receptacle part 21, and that is connected by crimping to one of the electrical wires of a wire harness (not shown in the figures). An elastic contact part 23 that makes elastic contact with a mating male contact (not shown in the figures) is disposed inside the receptacle part 21.

The retainer 30 is inserted from the front surface of the housing 10, and is locked in the housing 10 in a temporary locking position (see FIGS. 1A to 1C) that allows the insertion of the contacts 20 into the housing 10 and in a main locking position (see FIGS. 2A to 2C) that ensures that the contacts 20 do not slip out. The retainer 30 comprises a rectangular substantially flat front plate 31 that extends in the direction of length (left-right direction in FIG. 1A) so as to cover the front surface of the housing 10, and a plurality of upper-side regulating parts 33*a* and lower-side regulating parts 33*b* that respectively extend rearward from the areas in the vicinity of the upper and lower ends of the front plate 31.

The respective upper-side regulating parts 33*a* enter into the spaces 14 formed above the housing lances 12 at the time of main locking, and restrict the upward movement of the housing lances 12, thus ensuring that the contacts 20 of the upper row do not slip out. Furthermore, the respective lower-side regulating parts 33*b* enter into the spaces 14 formed beneath the housing lances 12 at the time of main locking, and restrict the downward movement of the housing lances 12, thus ensuring that the contacts 20 of the lower row do not slip out. A plurality of contact passage holes 32 in two rows (upper and lower rows) are formed in the front plate 31 in positions corresponding to the respective contact accommodating cavities 11. Furthermore, as is shown clearly in FIG. 1C and FIGS. 5 through 7, temporary locking projections 34 that prevent the retainer 30 from being pulled out in the forward direction when the retainer 30 is in the temporary locking position are respectively formed on the rear ends of the upper-side regulating parts 33*a* and lower-side regulating parts 33*b* that are positioned at both ends of the retainer 30 in the direction of length. The upper-side regulating parts 33*a* and lower-side regulating parts 33*b* constitute temporary locking arms. Furthermore, a pair of regulating parts 37 that enter the slits 15 of the upper row and restrict the upward movement of the receptacle parts 21 of the contacts 20 of the upper row are formed so that these regulating parts 37 protrude from the respective upper-side regulating parts 33*a*. Moreover, a pair of regulating parts 37 that enter the slits 15 of the lower row and restrict the downward movement of the receptacle parts 21 of the contacts 20 of the lower row are similarly formed so that these regulating parts 37 protrude from the respective lower-side regulating parts 33*b*.

Main locking arms 35 are respectively formed between the upper-side regulating part 33*a* at the leftmost end and the adjacent upper-side regulating part 33*a* and between the upper-side regulating part 33*a* at the rightmost end and the adjacent upper-side regulating part 33*a*. The respective main locking arms 35 are formed so that these arms 35 enter into the spaces 18 formed beneath the second long narrow openings 17 at the time of main locking. As is shown in FIGS. 1B and 2B, main locking projections 36 which prevent the retainer 30 from being pushed in toward the rear when the retainer 30 is in the temporary locking position, and which prevent the retainer 30 from being pulled out in the forward direction when the retainer 30 is in the main locking position, are formed to protrude from the respective main locking arms 35 in positions located slightly toward the rear (in the forward-rearward direction) of the respective main locking arms 35. As is shown in FIG. 2B, the main locking projections 36 are formed so that these projections 36 are exposed from the top surface of the housing 10 via the second long narrow openings 17 when the retainer 30 is in the main locking position.

As is shown in FIG. 2B, supporting parts 19*a* are formed beneath the spaces 18 of the housing 10. Supporting parts 19*a* support the back surface sides of the main locking arms 35 in the vicinity of the main locking projections 36 when the retainer 30 is in the main locking position. Flex permitting spaces 19*b* are formed in positions located further forward than the supporting parts 19*a* of the housing 10. The flex permitting spaces 19*b* allow flexing of the main locking arms 35 of the retainer 30 when the retainer 30 moves from the temporary locking position to the main locking position.

Figure 1C:
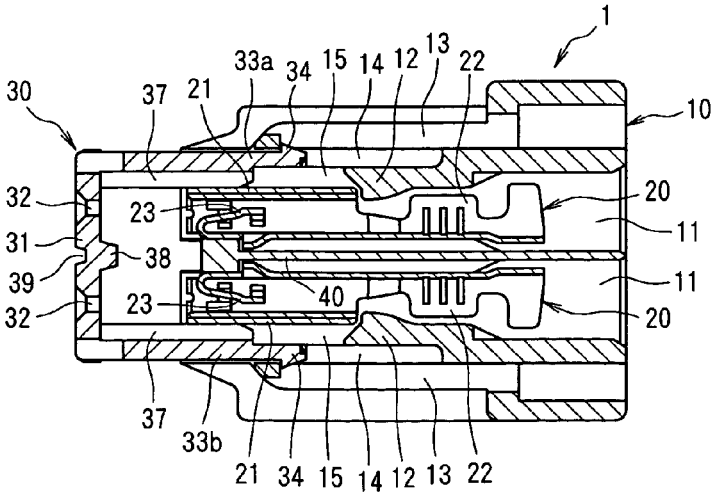

The retainer 30 also comprises a strip 38 that extends in the direction of length and that protrudes rearward from the center of the back surface of the front plate 31, and has a recessed groove 39 that extends in the direction of length in the center on the front surface of the front plate 31 and in a position corresponding to the strip 38. As is shown in FIGS. 1B and 1C, the strip 38 is formed so that this strip exhibits a trapezoidal cross-sectional shape that is tapered toward the rear, and the recessed groove 39 is also formed so that this recessed groove exhibits a trapezoidal cross-sectional shape that is tapered toward the rear to correspond to the shape of this strip 38. The height of the strip 38 is fixed along the direction of length, and the depth of the recessed groove 39 is also fixed along the direction of length. Furthermore, the recessed groove 43 formed in the housing 10 mates with the strip 38 when the retainer 30 is in the main locking position as shown in FIG. 2B. Thus, since the retainer 30 has the strip 38 that extends in the direction of length and that protrudes rearward from the center on the back surface of the front plate 31, the rigidity of the front plate of the retainer 30 can be increased. Moreover, since the retainer 30 has the recessed groove 39 that extends in the direction of length in the center on the front surface side of the front plate 31 in a position corresponding to the strip 38, the thickness of the area in the vicinity of the strip 38 can be made substantially uniform. Accordingly, the dimensional stability of the retainer 30 itself following molding is superior, and it is possible to prevent warpage of all of the upper-side regulating parts 33*a*, lower-side regulating parts 33*b* and main locking arms 35 that extend from the front plate 31.

Next, the method for assembling the electrical connector 1 will be described with reference to FIGS. 1A to 1C and 2A to 2C.

In the assembly of the electrical connector 1, the retainer 30 is first inserted from the front surface of the housing 10, and the retainer 30 is positioned in the temporary locking position as shown in FIGS. 1A to 1C. In this case, the retainer 30 is prevented from being pulled out in the forward direction as a result of the temporary locking projections 34 formed on the rear ends of the upper-side regulating parts 33*a* and lower-side regulating parts 33*b* contacting the front edges of the first long narrow openings 13, and the retainer 30 is prevented from being pushed in toward the rear as a result of the main locking projections 36 contacting the front edge of the top wall of the housing 10.

Next, the respective contacts 20 to which electrical wires have been connected are inserted into the respective contact accommodating cavities 11 from the rear side of the housing 10. As a result, the housing lances 12 are positioned on the rear sides of the receptacle parts 21 of the contacts 20, so that the contacts 20 are temporarily secured, thus preventing the contacts 20 from slipping out.

Figure 2A:
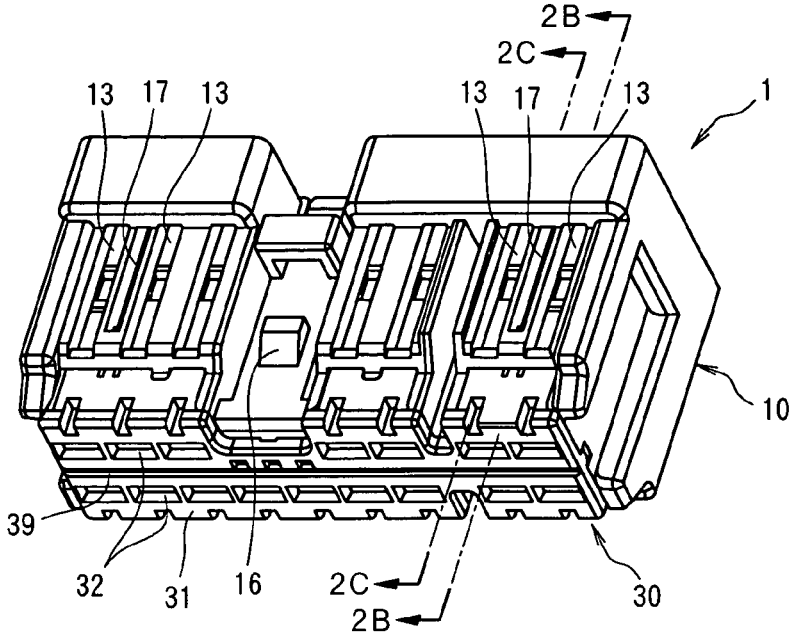
FIGS. 2A to 2C show an electrical connector according to an exemplary embodiment of the invention in a state in which the retainer is in the main locking position, with FIG. 2A being a perspective view, FIG. 2B being a sectional view along line 2B—2B in FIG. 2A, and FIG. 2C being a sectional view along line 2C—2C in FIG. 2A (here, the contacts are not shown in FIG. 2B)
Figure 2B:
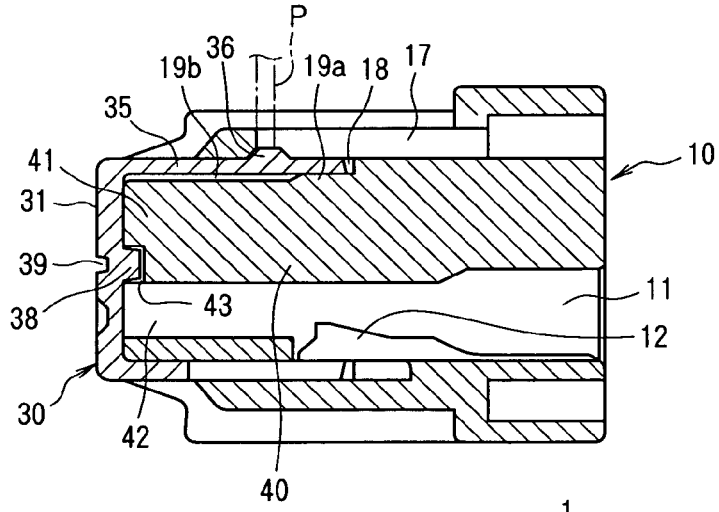
Figure 2C:
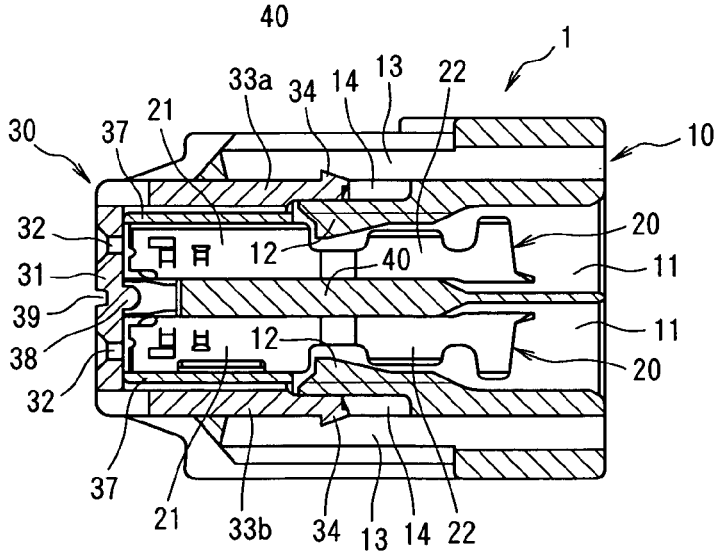
Figure 3:
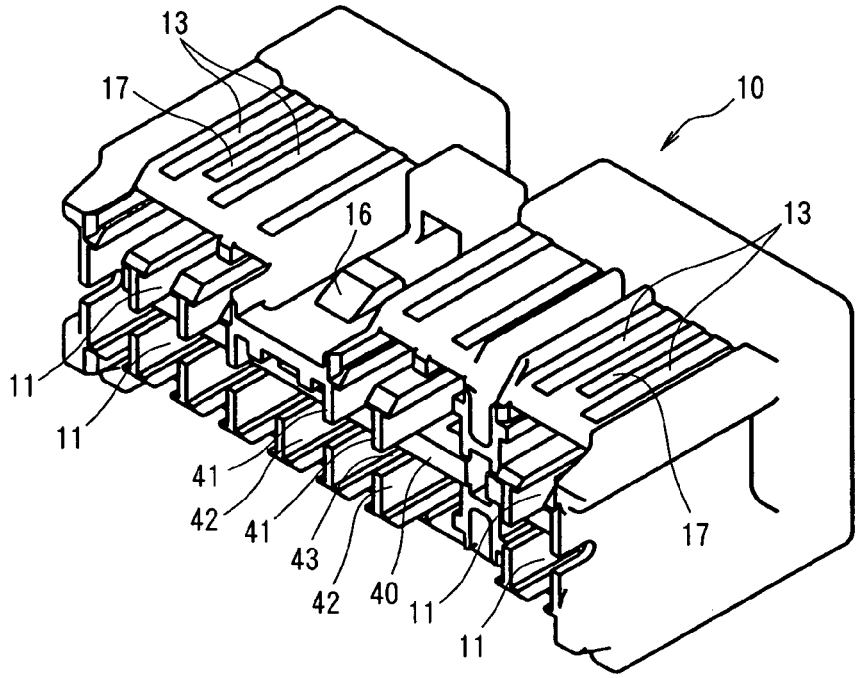
FIG. 3 is a perspective view in which the housing of the electrical connector of FIGS. 1A—2C is seen from the front at an inclination from above.
Figure 4:
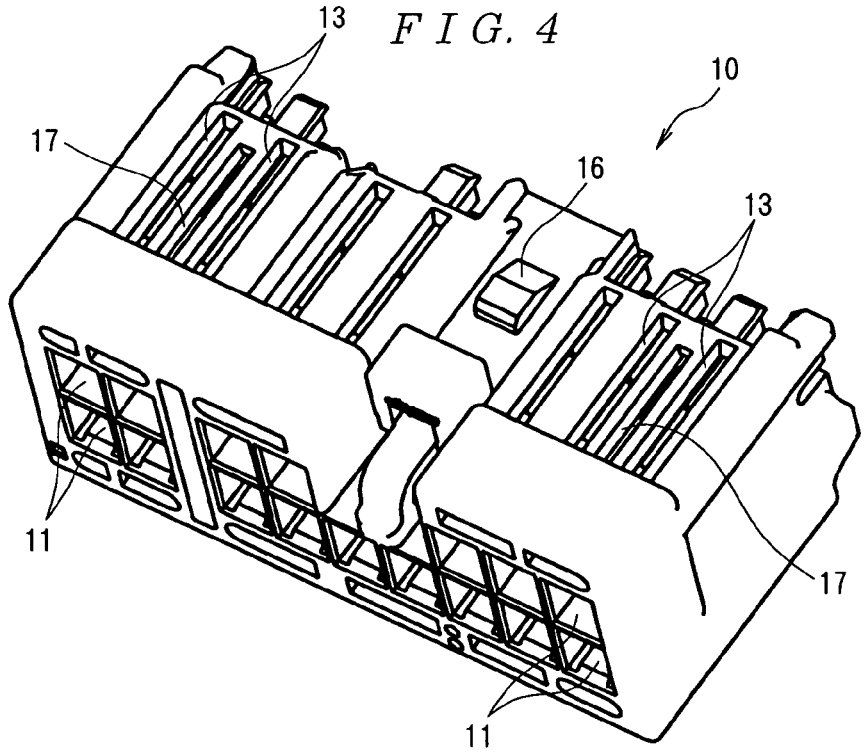
FIG. 4 is a perspective view in which the housing of FIG. 3 is seen from the rear at an inclination from above.
Figure 5:
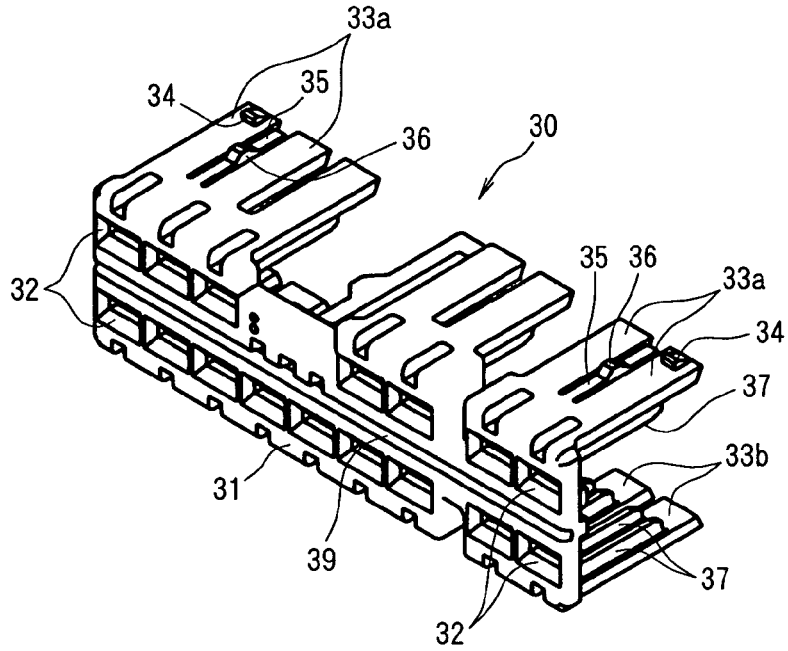
FIG. 5 is a perspective view in which the retainer of the electrical connector of FIGS. 1A–2C is seen from the front at an inclination from above.
Figure 6:
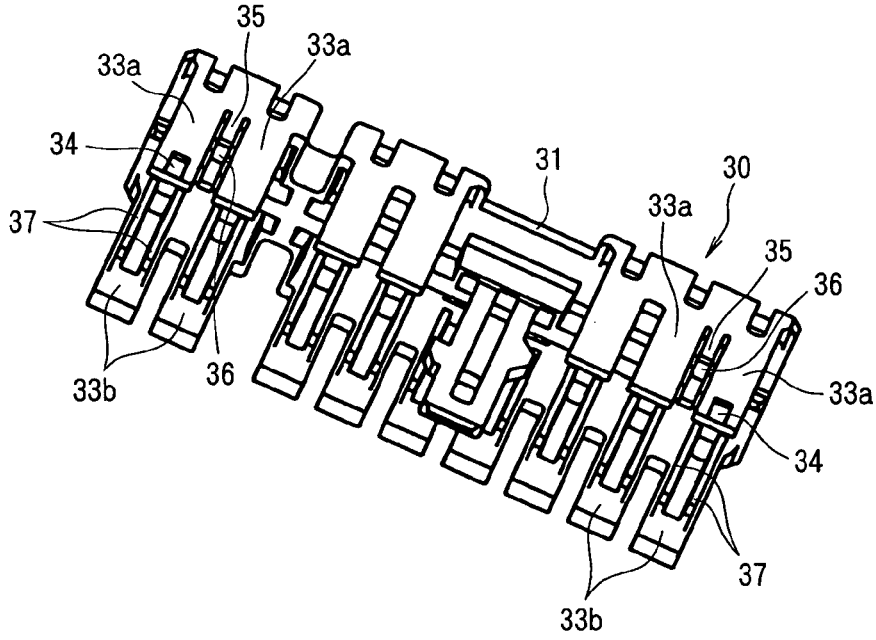
FIG. 6 is a perspective view in which the retainer of FIG. 5 is seen from the rear at an inclination from above.
Figure 7:
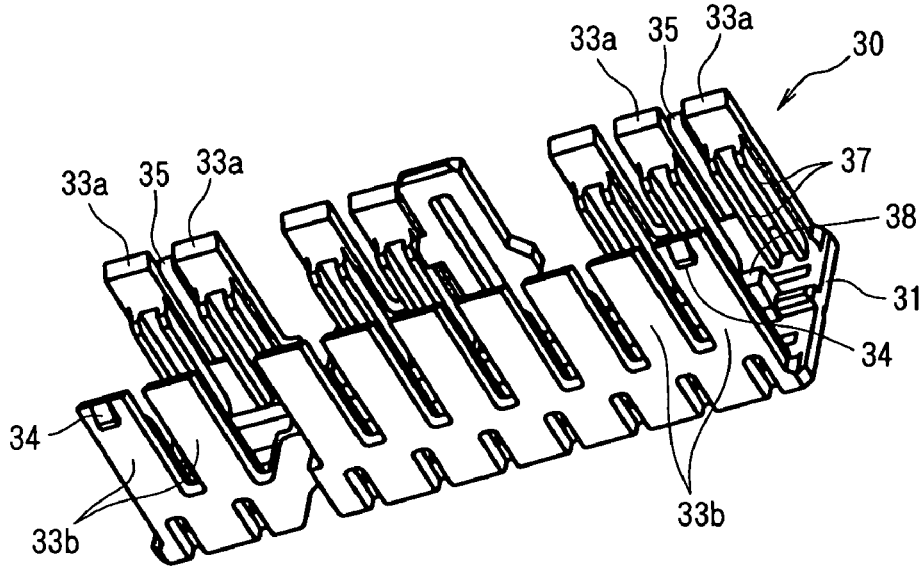
FIG. 7 is a perspective view in which the retainer of FIG. 5 is seen from the rear at an inclination from below.
Figure 8:
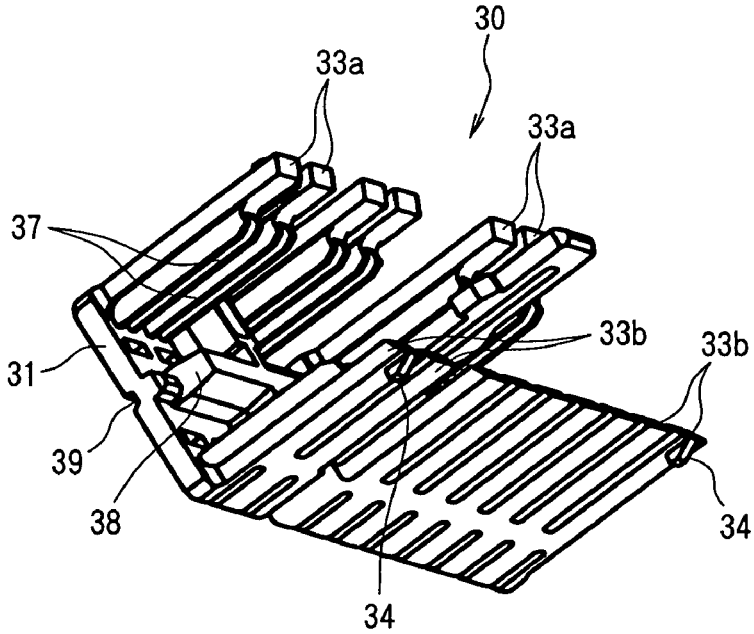
FIG. 8 is a perspective view in which the retainer of FIG. 5 is seen from the rear at an inclination from below from an angle that is different from that in FIG. 7.
Figure 9:
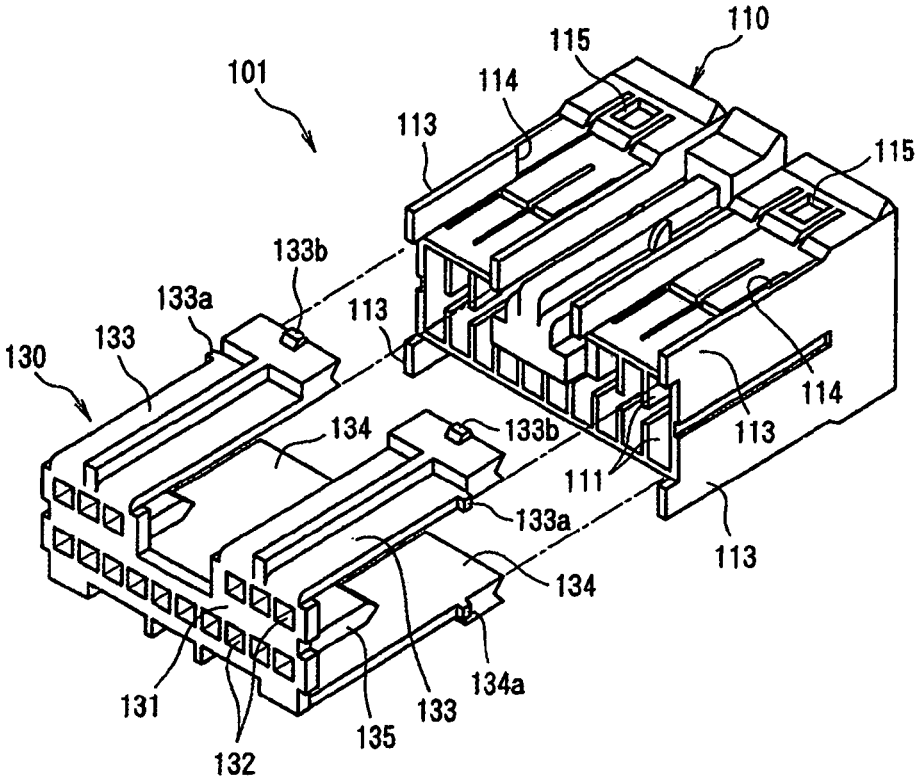
PRIOR ART FIG. 9
FIG. 9 is a perspective view of a conventional example of an electrical connector.
Figure 10:
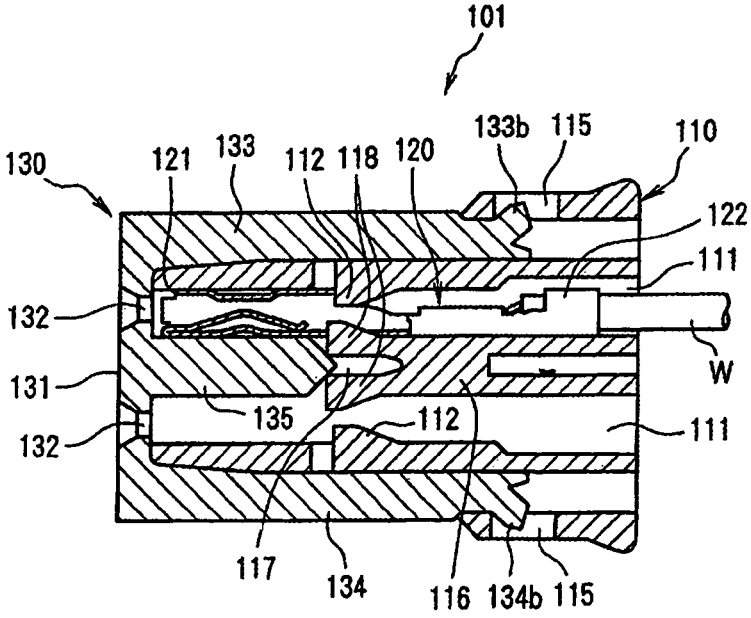
PRIOR ART FIG. 10
FIG. 10 is a sectional view of the electrical connector shown in FIG. 9.

Subsequently, the retainer 30 that is in the temporary locking position is pushed rearward so that the retainer 30 is positioned in the main locking position as shown in FIGS. 2A to 2C. In this case, the main locking arms 35 of the retainer 30 enter into the spaces 18 formed beneath the second long narrow openings 17, and the main locking projections 36 contact the front edges of the second long narrow openings 17, so that the retainer 30 is prevented from being pulled out in the forward direction. In the case of this main locking, furthermore, the upper-side regulating parts 33*a* of the retainer 30 enter into the spaces 14 formed above the housing lances 12, so that the upward movement of the housing lances 12 is restricted, thus ensuring that the contacts 20 of the upper row are prevented from slipping out. Moreover, the lower-side regulating parts 33*b* of the retainer 30 enter into the spaces 14 formed beneath the housing lances 12, so that the downward movement of the housing lances 12 is restricted, thus ensuring that the contacts 20 of the lower row are prevented from slipping out. As a result, the assembly of the electrical connector 1 is completed.

Furthermore, when the retainer 30 is in the main locking position, the strip 38 disposed on the retainer 30 mates with the recessed groove 43 formed in the housing 10 as shown in FIG. 2B, so that backlash of the retainer 30 at the time of main locking can be stopped.

Moreover, when the retainer 30 is to be moved from the temporary locking position to the main locking position, this is accomplished by pushing the front plate 31 of the retainer 30 toward the rear with a finger. In this case, the recessed groove 39 formed in the front plate 31 of the retainer 30 functions as an anti-slip part for the finger.

The embodiment of the present invention was described above. However, the present invention is not limited to this embodiment, and various alterations and modifications may be made.

For example, it is not absolutely necessary that the strip 38 be formed with a trapezoidal cross-sectional shape that is tapered toward the rear, as long as this strip 38 has a shape that protrudes rearward from the front plate 31. Furthermore, the recessed groove 39 does not necessarily have to be formed with a trapezoidal cross-sectional shape that is tapered toward the rear, either, as long as this recessed groove 39 is formed in a position that corresponds to the strip 38. Moreover, the height of the strip 38 does not need to be constant along the direction of length, and the depth of the recessed groove 39 also does not need to be constant along the direction of length.

What is claimed is:

1. An electrical connector comprising:

an insulating housing;

contacts that are accommodated in this housing; and a retainer that is inserted from the front surface of the housing, and that is locked to the housing in a temporary locking position that allows the insertion of the contacts into the housing and in a main locking position that ensures that the contacts are prevented from slipping out of the housing, the retainer having a front plate that has contact passage holes, and locking arms that extend rearward from the upper and lower ends of the front plate, wherein the retainer comprises a strip that protrudes rearward from the center of the front plate on a back surface thereof, and also has a recessed groove that extends in the center of the front plate on a front surface thereof and in a position corresponding to the strip, and the housing has a recessed groove that mates with the strip when the retainer is in the main locking position.

2. The electrical connector of claim 1, wherein the contacts are accommodated in contact cavities, the rows being separated by a central partition wall and the cavities in each row being separated by cavity partition walls.

3. The electrical connector of claim 2, wherein the recessed groove in the housing is defined by the cavity partition walls protruding further forward than the central partition wall.

4. The electrical connector of claim 1, wherein the strip extends in the direction of length of the retainer.

5. An electrical connector, comprising:

an insulating housing having a plurality of contacts accommodated in contact accommodating cavities, the housing having a recessed groove formed inside the housing between the contact accommodating cavities; and a retainer that is inserted from a front surface of the housing, the retainer being moveable between a temporary locking position that allows insertion of the contacts into the housing and a main locking position that locks the contacts in the housing, the retainer having a front plate with contact passage holes, the front plate having locking arms extending rearward from upper and lower ends thereof and a strip that protrudes rearward from a back surface thereof that mates with the recessed groove of the housing in the main locking position.

6. The electrical connector of claim 5, wherein the retainer includes a recessed groove formed on a front surface of the front plate in a position corresponding to the strip.

7. The electrical connector of claim 6, wherein adjacent contact accommodating cavities are separated by cavity partition walls and a central partition wall divides the contact accommodating cavities into upper and lower rows.

8. The electrical connector of claim 7, wherein the recessed groove in the housing is defined by the cavity partition walls protruding further forward than the central partition wall.

9. The electrical connector of claim 6, wherein the strip extends along a direction of length and has a fixed height along the direction of length.

10. The electrical connector of claim 9, wherein the recessed groove of the retainer extends along the direction of length has a fixed depth along the direction of length.

11. The electrical connector of claim 10, wherein the strip and the recessed groove of the retainer are formed in a center of the front plate.

12. The electrical connector of claim 6, wherein the strip and the recessed groove of the retainer have a trapezoidal cross-sectional shape that is tapered towards a rear thereof.

* * * * *